US007205943B2

(12) United States Patent
Mei

(10) Patent No.: US 7,205,943 B2
(45) Date of Patent: Apr. 17, 2007

(54) PRINTED ANTENNA

(75) Inventor: Chia-Hao Mei, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/198,515

(22) Filed: Aug. 5, 2005

(65) Prior Publication Data

US 2006/0049989 A1 Mar. 9, 2006

(30) Foreign Application Priority Data

Sep. 3, 2004 (TW) ..... 93214033 U

(51) Int. Cl.
*H01Q 1/38* (2006.01)

(52) U.S. Cl. ..... 343/700 MS; 343/846

(58) Field of Classification Search ..... 343/700 MS, 343/702, 846, 848
See application file for complete search history.

(56) References Cited

U.S. PATENT DOCUMENTS 5,847,682 A * 12/1998 Ke ..... 343/752
6,809,687 B2 * 10/2004 Yuanzhu ..... 343/700 MS
6,850,199 B2 * 2/2005 Chen et al. ..... 343/702
6,958,730 B2 * 10/2005 Nagumo et al. ..... 343/702
7,042,401 B2 * 5/2006 Park et al. ..... 343/700 MS
7,071,877 B2 * 7/2006 Okado ..... 343/700 MS
2003/0043079 A1 * 3/2003 Chen ..... 343/702

FOREIGN PATENT DOCUMENTS

TW 091121984 10/2003

* cited by examiner

*Primary Examiner*—Tan Ho
(74) *Attorney, Agent, or Firm*—Morris Manning & Martin LLP; Tim Tingkang Xia, Esq.

(57) ABSTRACT

A printed antenna on a substrate for radiating and capturing radio frequency signals includes a ground portion, a feeding element and a radiating portion. The radiating portion is a main body of the printed antenna, and includes a connecting patch and a radiating patch. One end of the connecting patch is electronically connected to the feeding element. The connecting patch is tapered, with a width thereof gradually decreasing in a direction toward the feeding element. The radiating patch is electronically connected to the connecting patch, and has an inverted V-shape.

18 Claims, 4 Drawing Sheets

PRINTED ANTENNA

BACKGROUND OF THE INVENTION

1. Field of the Invention

The present invention pertains to printed antennas made on substrates, and particularly to a printed antenna disposed on a substrate of, for example, a wireless local area network (WLAN) device.

2. Prior Art

Nowadays, wireless communication devices, such as mobile phone handsets and portable computers, are becoming more and more popular. In order for these wireless devices to communicate with one or more base stations, the wireless devices usually have to be equipped with an antenna. The characteristics of the antenna, such as efficient radiation, orientation, and frequency band, are closely connected with performance of the wireless device. At the same time, the antenna should generally also be small, light in weight, and have low radiation. There are two main kinds of antennas: one is a built-in antenna, and the other is an external antenna. In contrast to the external antenna, the size of the built-in antenna is usually smaller, and the body of the built-in antenna is less prone to be damaged.

Two kinds of built-in antennas are popularly employed: a chip antenna and a planar antenna. A printed antenna is a kind of planar antenna, and in general has the advantage of small size, low cost and simple manufacturing. With the development of the technology of wireless communications, the IEEE (The Institute of Electrical and Electronics Engineers) 802.11a standard has become one of the main technology standards of WLANs (Wireless Local Area Networks). The working frequency band of IEEE 802.11a covers the range 5.15~5.825 GHz, and comprises 5.15~5.25 GHz, 5.25~5.35 GHz and 5.725~5.825 GHz.

In order to make wireless communication devices compatible with the IEEE 802.11a standard, some new printed antennas with a working frequency band covering 5.15~5.825 GHz have been developed. An example of such printed antenna is disclosed in Taiwan Patent No. 557608 issued on Oct. 11, 2003. The printed antenna integrates two constituent antennas into one: one operating in the frequency band of the IEEE 802.11a standard, and the other operating in the frequency band of the IEEE 802.11b standard. In short, the integrated antenna comprises two antennas that make the integrated antenna operate in a wider frequency band. However, each of the antennas has a complicated and cumbersome structure, which inflates the manufacturing cost of the integrated antenna.

In addition, many wireless communication devices need only operate on the frequency band of the IEEE 802.11a standard. Therefore, a new printed antenna with a small size and simple structure is desired to overcome the above-mentioned disadvantages of the prior art.

SUMMARY OF THE INVENTION

Accordingly, an object of the present invention is to provide a small sized printed antenna that operates on the frequency band of the IEEE 802.11a standard.

Another object of the present invention is to provide an integrated antenna having higher gain for better performance.

In order to accomplish the first of the above-mentioned objects, a printed antenna on a substrate for radiating and capturing radio frequency signals comprises a ground portion, a feeding element and a radiating portion. The radiating portion is a main body of the printed antenna, and comprises a connecting patch and a radiating patch. One end of the connecting patch is electronically connected to the feeding element. The connecting patch is tapered, with a width thereof gradually decreasing in a direction toward the feeding element. The radiating patch is electronically connected to the connecting patch, and has an inverted V-shape.

In order to accomplish the second of the above-mentioned objects, an integrated antenna comprises a substrate, a first printed antenna, and a second printed antenna. The substrate has two opposite first and second surfaces. The first printed antenna and the second printed antenna are respectively disposed on the two opposite first and second surfaces, and are symmetrically opposite each other. Both the first printed antenna and the second printed antenna have the same structure, which comprises a ground portion, a feeding element, and a radiating portion. The radiating portion comprises a connecting patch, and a radiating patch having an inverted V-shape.

Other objectives, advantages and novel features of the present invention will be drawn from the following detailed description of preferred embodiments of the present invention with the attached drawings, in which:

DETAILED DESCRIPTION OF THE INVENTION

Figure 1:
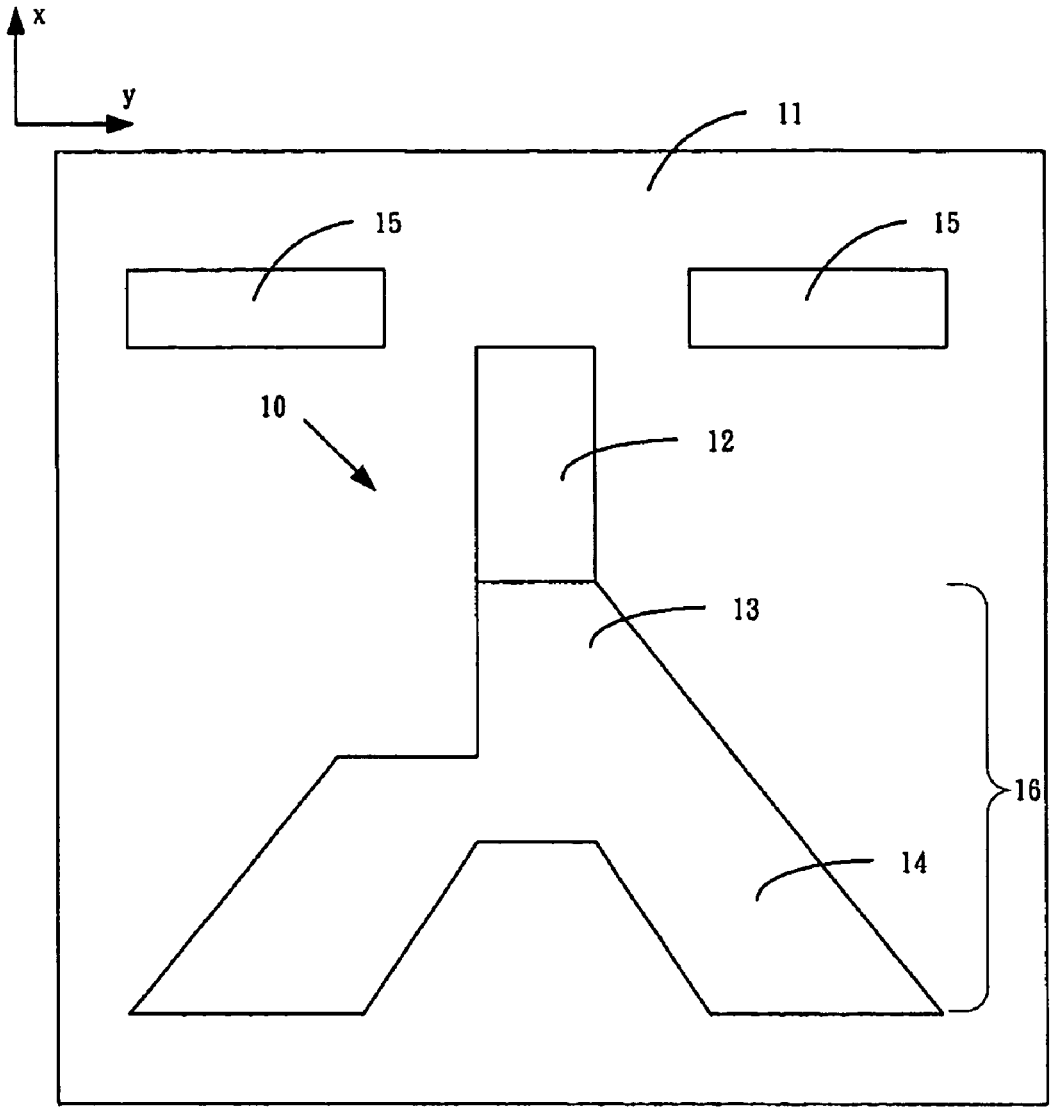
FIG. 1 is a top plan view of a printed antenna in accordance with a first preferred embodiment of the present invention.

FIG. 1 is a top plan view of a printed antenna 10 of an antenna device in accordance with a first preferred embodiment of the present invention. The printed antenna 10 operates in 4.9~6 GHz frequency bands, which cover the total bandwidth of the IEEE 802.11a standard. The printed antenna 10 is disposed on a substrate 11, and comprises a feeding element 12 and a radiating portion 16. The radiating portion 16 comprises a connecting patch 13 and a radiating patch 14.

In the first preferred embodiment of the present invention, the feeding element 12 is a conductive line with 2 mm long and 1 mm wide. A resistance of the feeding element 12 is 50 ohm. A two-part ground portion 15 is disposed beside the feeding element 12.

The radiating portion 16 is a main body of the printed antenna 10, which resonates at a frequency of 5.5 GHz in the present invention. The radiating portion 16 has a generally inverted V-shape, with a right-angled cutout at a top thereof. The connecting patch 13 is a top portion of the inverted V-shape, and is electronically connected to the feeding element 12. The radiating patch 14 is a bottom portion of the inverted V-shape with two extending branches, and one end of the radiating patch 14 is electronically connected to the connecting patch 13.

Figure 2:
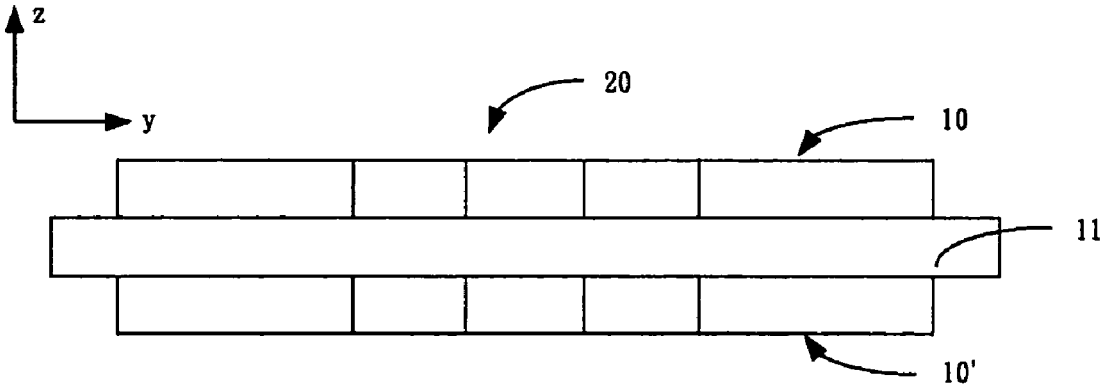
FIG. 2 is a side plan view of an integrated antenna in accordance with a second preferred embodiment of the present invention, viewed along an X axis direction.

FIG. 2 is a side plan view of an integrated antenna 20 of an antenna device in accordance with a second preferred embodiment of the present invention, viewed along the X axis direction (see FIG. 1). The integrated antenna 20 comprises a first printed antenna 10 and a second printed antenna 10' respectively disposed on two opposite first and second surfaces of a substrate 11. The first printed antenna 10 and the second printed antenna 10' have the same structure, according to the above-described structure of the printed antenna 10. The first printed antenna 10 on the first surface and the second printed antenna 10' on the second surface are symmetrically opposite each other. The integrated antenna 20 employs the first and second printed antennas 10 and 10' to add radiation areas for effectively improving gains.

Figure 3:
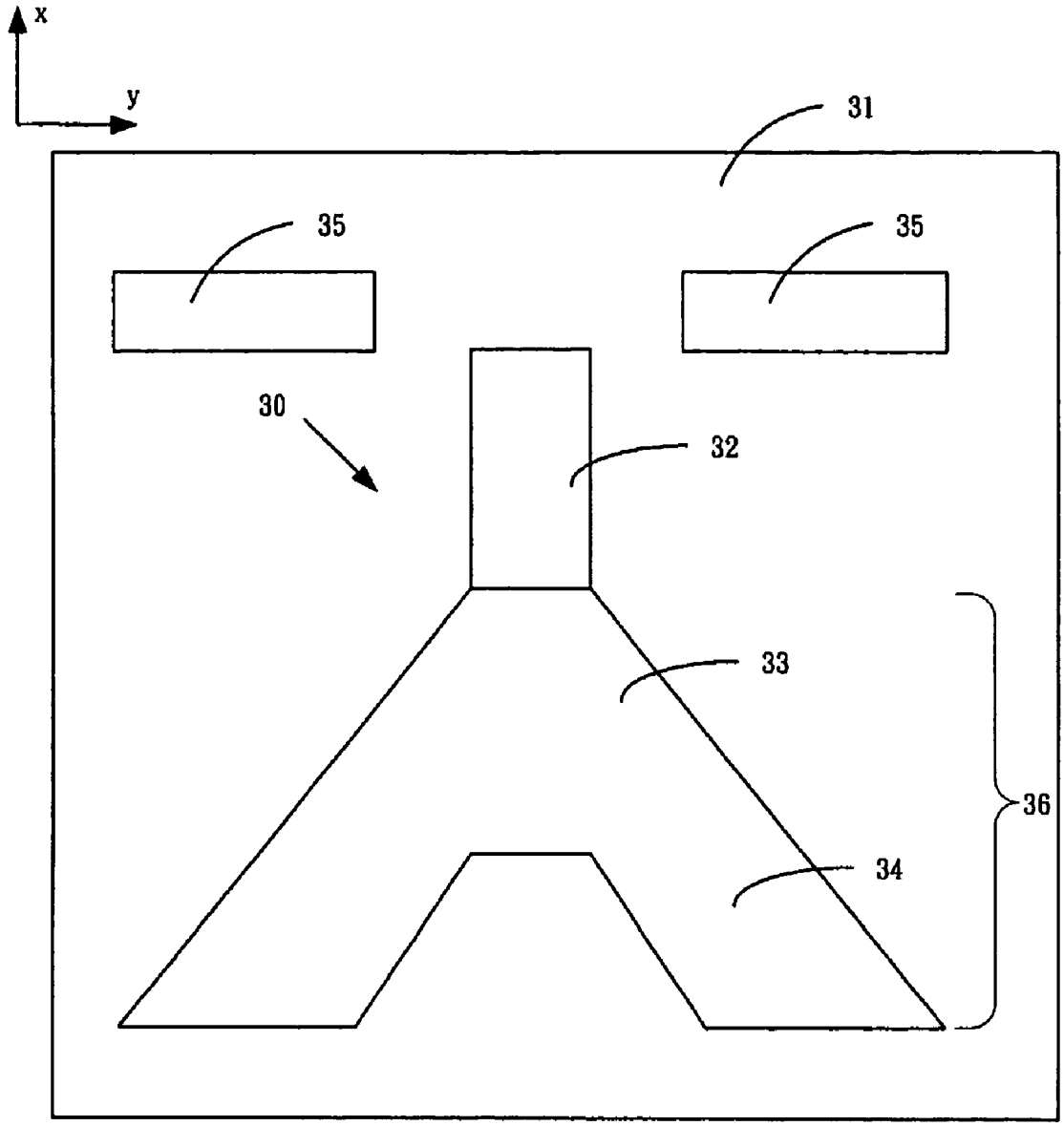
FIG. 3 is a top plan view of a printed antenna in accordance with a third preferred embodiment of the present invention.

FIG. 3 is a top plan view of a printed antenna 30 of an antenna device in accordance with a third preferred embodiment of the present invention. The printed antenna 30 is disposed on a surface of a substrate 31, and comprises a two-part ground portion 35, a feeding element 32 and a radiating portion 36. The feeding element 32 is a conductive line 2 mm long and 1 mm wide, and a resistance of the feeding element 32 is 50 ohm. The radiating portion 36 has a generally inverted V-shape, and comprises a connecting patch 33 and a radiating patch 34. The connecting patch 33 is a top portion of the inverted-V-shape, and is electronically connected to the feeding element 32. The radiating patch 34 is a bottom portion of the inverted-V-shape, and one end thereof is electronically connected to the connecting patch 33.

Figure 4:
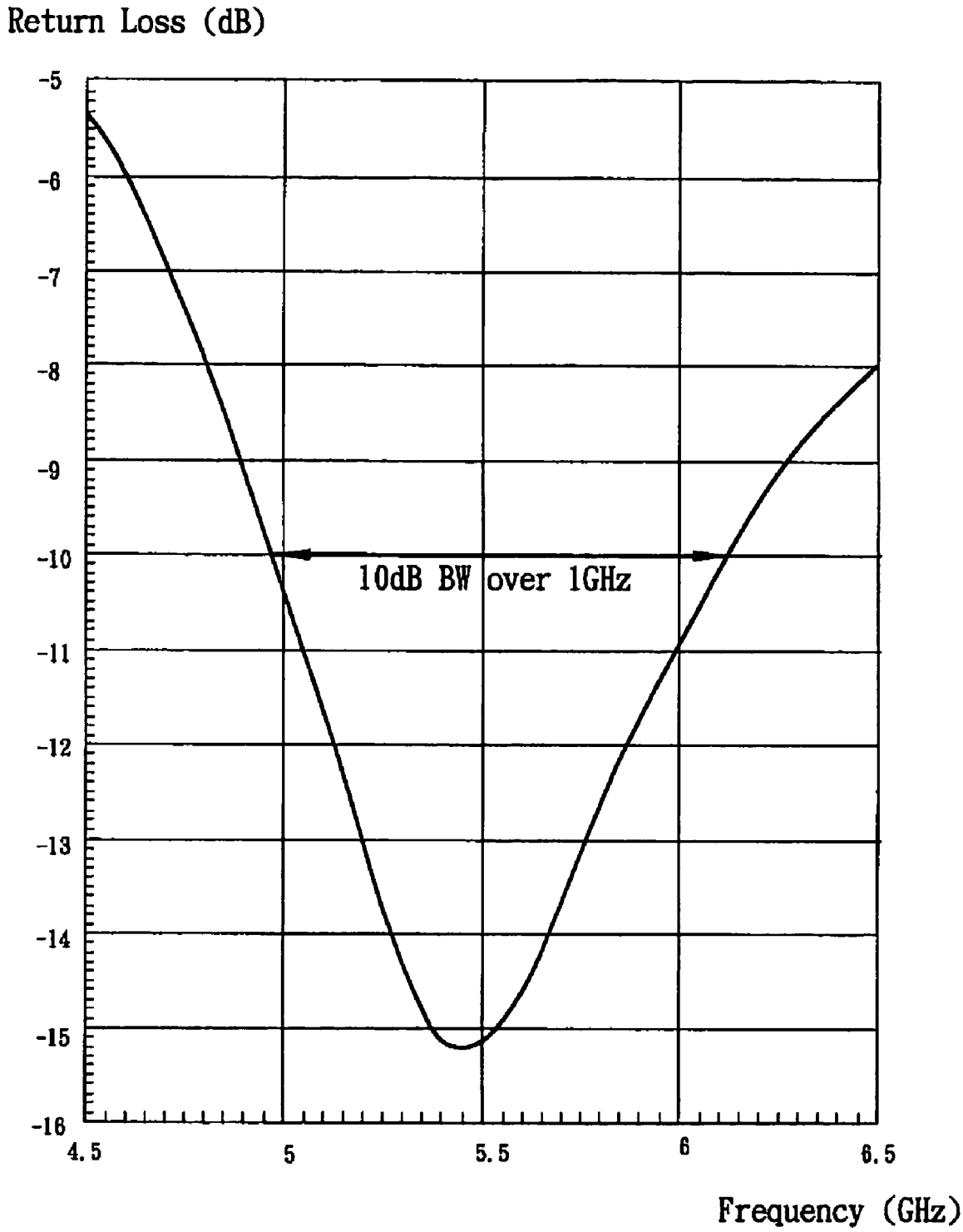
FIG. 4 is a test chart showing return loss of the printed antenna of FIG. 2.

FIG. 4 is a test chart showing return loss of the printed antenna of FIG. 2. When the printed antenna 20 operates in frequency bands of 4.9~6 GHz, return loss drops below −10 dB.

Figure 5:
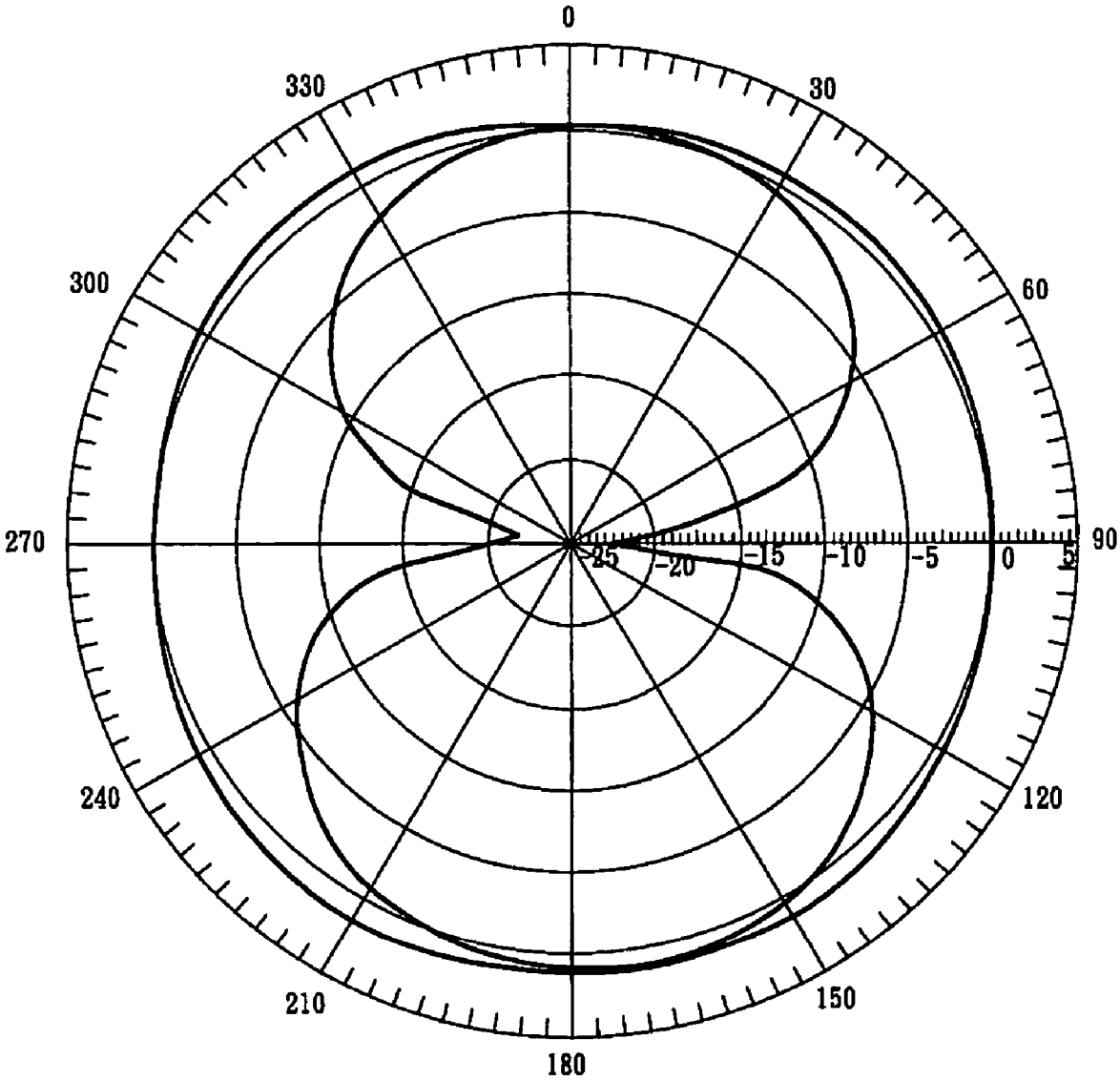
FIG. 5 is a test chart showing a measured radiation pattern in a horizontal and a vertical plane when the printed antenna of FIG. 2 is operated at a frequency of 5.5 GHz.

FIG. 5 is a test chart showing a measured radiation pattern in a horizontal and a vertical plane when the printed antenna 20 of FIG. 2 is operated at a frequency of 5.5 GHz. It is to be noted that the radiation pattern in the horizontal plane is close to an optimal radiation pattern, with no significant radiating blind area, and that the maximum value of the gain is 1.38 dB.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A printed antenna printed on a substrate for radiating and capturing radio frequency signals, the printed antenna comprising:

a feeding element;

a ground portion disposed beside the feeding element; and a radiating portion, comprising:

a connecting patch electronically connected with the feeding element, a width of the connecting patch gradually decreasing in a direction toward the feeding element; and a radiating patch with one end thereof electronically connected with the connecting patch; wherein a right-angled cutout is defined next to the connecting patch beside the feeding element.

2. The printed antenna as recited in claim 1, wherein the feeding element is a conductive line.

3. The printed antenna as recited in claim 1, wherein the radiating patch has an inverted V-shape.

4. The printed antenna as recited in claim 1, wherein the radiating patch has at least two branches extending away from the connecting patch.

5. The printed antenna as recited in claim 4, wherein the at least two branches are symmetrically defined mainly in the radiating patch.

6. An integrated antenna for radiating and capturing radio frequency signals, comprising:

a substrate having two opposite surfaces;

two printed antennas respectively disposed on the opposite surfaces of the substrate, each of the antennas comprising:

a feeding element;

a ground portion disposed beside the feeding element; and a radiating portion, comprising:

a connecting patch electronically connected with the feeding element, a width of the connecting patch gradually decreasing in a direction toward the feeding element; and a radiating patch, with one end thereof electronically connected with the connecting patch.

7. The integrated antenna as recited in claim 6, wherein the two printed antennas are symmetrically arranged on the two surfaces of the substrate.

8. The integrated antenna as recited in claim 6, wherein the feeding element is a conductive line.

9. The integrated antenna as recited in claim 6, wherein the radiating patch has an inverted V-shape.

10. The integrated antenna as recited in claim 6, wherein the radiating patch has at least two branches extending away from the connecting patch.

11. The integrated antenna as recited in claim 10, wherein the at least two branches are symmetrically defined mainly in the radiating patch.

12. The integrated antenna as recited in claim 6, wherein a right-angled cutout is defined next to the connecting patch beside the feeding element.

13. An antenna device for radiating and capturing radio frequency signals, comprising:

a substrate;

an antenna formed on a surface of said substrate, said antenna comprising a feeding element, at least one grounding portion beside and spaced from said feeding element, and a radiating portion, said radiating portion electrically connected with said feeding element and having at least two branches extending away from said feeding element; and another antenna formed on another surface of said substrate opposite to said antenna.

14. The antenna device as recited in claim 13, wherein said radiating portion is substantially in an inverted "V" shape.

15. The antenna device as recited in claim 13, wherein said radiating portion comprises a connecting patch electrically connected with said feeding element, and a radiating patch electrically connected with said connecting patch and spaced away from said feeding element.

16. The antenna device as recited in claim 15, wherein a width of said connecting patch decreases gradually in a direction toward said feeding element.

17. The antenna device as recited in claim 15, wherein said at least two branches are symmetrically defined mainly in said radiating patch.

18. The antenna device as recited in claim 15, wherein a right-angled cutout is defined next to said connecting patch beside said feeding element.

* * * * *